US010035525B2

(12) United States Patent
Lenzi et al.

(10) Patent No.: US 10,035,525 B2
(45) Date of Patent: Jul. 31, 2018

(54) ENERGY-ABSORBING DEVICE, IN PARTICULAR FOR A RAIL-CAR

(71) Applicant: HITACHI RAIL ITALY S.p.A., Naples (IT)

(72) Inventors: Luca Lenzi, Cantagrillo (IT); Angelo Surini, Serravalle Pistoiese (IT); Samuele Pacini, Quarrata (IT)

(73) Assignee: HITACHI RAIL ITALY S.P.A., Naples (IT)

( * ) Notice: Subject to any disclaimer, the term of this patent is extended or adjusted under 35 U.S.C. 154(b) by 173 days.

(21) Appl. No.: 15/117,393

(22) PCT Filed: Feb. 27, 2015

(86) PCT No.: PCT/IB2015/051475

§ 371 (c)(1),
(2) Date: Aug. 8, 2016

(87) PCT Pub. No.: WO2015/128850

PCT Pub. Date: Sep. 3, 2015

(65) Prior Publication Data

US 2016/0347333 A1 Dec. 1, 2016

(30) Foreign Application Priority Data

Feb. 27, 2014 (IT) ..... TO2014A0164

(51) Int. Cl.
*B61G 11/16* (2006.01)
*B61G 11/18* (2006.01)

(52) U.S. Cl.
CPC ..... *B61G 11/16* (2013.01); *B61G 11/18* (2013.01)

(58) Field of Classification Search
CPC . B61G 9/20; B61G 11/06; B61G 9/04; B61G 11/16; B61G 11/18; B60R 19/34;
(Continued)

(56) References Cited

U.S. PATENT DOCUMENTS 6,406,088 B1 * 6/2002 Tate ..... B62D 21/152 188/371
6,472,043 B1 * 10/2002 Kobayashi ..... F16F 7/121 428/116

FOREIGN PATENT DOCUMENTS

DE 435 308 10/1926
DE 462 539 7/1928
(Continued)

*Primary Examiner* — Mark T Le
(74) *Attorney, Agent, or Firm* — Leason Ellis LLP

(57) ABSTRACT

An energy-absorbing device, in particular for a rail-car, extends along an axis and has an attachment member, which can be connected to a fixed structure, an impact member, designed to withstand an impact, and an energy-absorbing member, constituted by a first tube and a second tube, which are coaxial and are made of composite material in order to collapse and hence absorb energy in the event of impact; the first tube is fixed to the attachment member, whereas the second tube is fixed to the impact member and is axially slidable, during impact, guided by the first tube; the radial thickness of the two tubes decreases along the axis, towards their free ends; in a non-collapsed resting condition, the axial gaps present between the two free ends and the attachment and impact members are substantially the same so that the two tubes start to collapse simultaneously in the event of impact.

10 Claims, 4 Drawing Sheets

(58) Field of Classification Search
CPC ..... B60R 19/14; B62D 21/152; B62D 21/15;
F16F 7/125; F16F 7/12; B23P 15/20
See application file for complete search history.

(56) References Cited

FOREIGN PATENT DOCUMENTS

| | | | |
|---|---|---|---|
| DE | 578 288 | * | 6/1933 |
| DE | 195 26 119 | | 1/1997 |
| DE | 10 2006 043 982 | * | 3/2008 |
| EP | 2 011 713 | | 1/2009 |

* cited by examiner

ENERGY-ABSORBING DEVICE, IN PARTICULAR FOR A RAIL-CAR

CROSS REFERENCE TO RELATED APPLICATIONS

The present application is a U.S. National Phase of International Patent Application PCT/IB2015/051475 filed on Feb. 27, 2015, which claims priority to Italian Application No. TO2014A000164, filed on Feb. 27, 2014, each of which is incorporated by reference as if expressly set forth in their respective entireties herein.

TECHNICAL FIELD

The present invention relates to an energy-absorbing device, in particular for a rail-car.

BACKGROUND ART

As is known, rail-cars (powered railway carriage, coaches, etc.) of surface and underground trains have, at their ends, collapsible devices pre-arranged for absorbing energy in the event of head-on collision so as to safeguard the body that accommodates the passengers and/or drivers. In general, a collapsible device comprises a box-like body made of metal material coupled to an end plate, usually provided with anti-climbing ribbings. In the event of a head-on collision against said end plate, the box-like body undergoes plastic deformation and hence absorbs kinetic energy.

Normally, during a head-on collision, the collapsible devices are not perfectly aligned with the ones against which they impact, but an offset in a vertical direction or else an angular offset is present between their axes. These offsets generate an asymmetrical distribution of the load between the collapsible devices, so that the conditions of impact and the amount of energy absorbed differ from what would be expected according to design.

In order to overcome these drawbacks, it is known to provide a guide device inside the box-like body of the collapsible device. For example, the patent EP2011713 illustrates a guide device having a series of vertical diaphragms, which are set at a distance apart, are perforated axially and are engaged by a stem fixed to the end plate. During impact, the stem recedes and slides into the diaphragms, which thus guide it so as to limit any rotations of the end plate.

The known solutions just described a not satisfactory in so far as: they frequently require a free space behind the box-like body for housing the stem at the end of plastic deformation; they comprise a relatively high number of components on account of the guide device; and they have a relatively high weight.

In order to reduce the weight of the box-like bodies, it is known to use composite materials, instead of metal materials, but in these cases there arises the problem of managing to obtain the same performance levels provided by traditional collapsible devices made of metal material.

As regards collapsible devices made of composite material, DE19526119A describes a solution that corresponds to the preamble of Claim 1 and that comprises a first tube, which is supported by the frame of a vehicle and defines a guide for a second tube.

The rear end of the second tube is housed in the first tube and is axially aligned with a serrated element, which crushes, or shatters, the second tube when the latter recedes as a result of a head-on collision. Progressive crushing, or shattering, of the composite material can be likened to plastic deformation of metal materials, in so far as both of these phenomena of collapse enable energy absorption.

In DE19526119A, the front portion of the second tube projects with respect to the first tube and supports another serrated element, which starts to crush the first tube when it reaches the free end of the latter. Starting from this instant, also the first tube collapses, crushing starting from its free end. In particular, the profile of both of the tubes may have a cross section that varies along their axial dimension to obtain a desired gradient of energy absorbed during impact.

Also this solution, however, presents some drawbacks.

In the first place, during a first step of the impact only the second tube is crushed and absorbs energy so that energy absorption is not maximized. In addition, at the point where also the first tube must start to be crushed, the characteristic curve that defines the compressive strength of the collapsible device presents a sharp variation, which may entail an anomaly in the real behaviour of the collapsible device as compared to the behaviour expected according to design.

The second tube is relatively long and slender and, on account of its front cantilever portion, is not adequate to withstand a direct impact with an offset with respect to its axis. In fact, with a misaligned or inclined load, given that said front portion is not directly constrained to the first tube, it undergoes bending, which could cause failure of the second tube in an intermediate point.

Furthermore, the solution presented in DE19526119A requires serrated elements for triggering crushing of the two tubes at their ends, so that it has a relatively high number of components to be produced and assembled.

In addition, during and at the end of impact, the second tube is substantially free to come out, whereas it is necessary for it to remain stationary with respect to the first tube. In fact, in the case of a head-on collision between two carriages, the anti-climbing plates of their collapsible elements may uncouple from one another on account of one or more rebounds (due in particular to a pre-set failure of the interconnection elements between the bodies of the carriages), but they must not change position so that they can couple up again together and continue to perform their function properly.

DISCLOSURE OF INVENTION

The aim of the present invention is to provide an energy-absorbing device, in particular for a rail-car, that will enable a simple and inexpensive solution to the problems set forth above.

According to the present invention an energy-absorbing device, in particular for a rail-car, is provided as defined in Claim 1.

BRIEF DESCRIPTION OF THE DRAWINGS

The invention will be now described with reference to the annexed drawings, which illustrate a non-limiting example of embodiment thereof and in which.

BEST MODE FOR CARRYING OUT THE INVENTION

Figure 1:
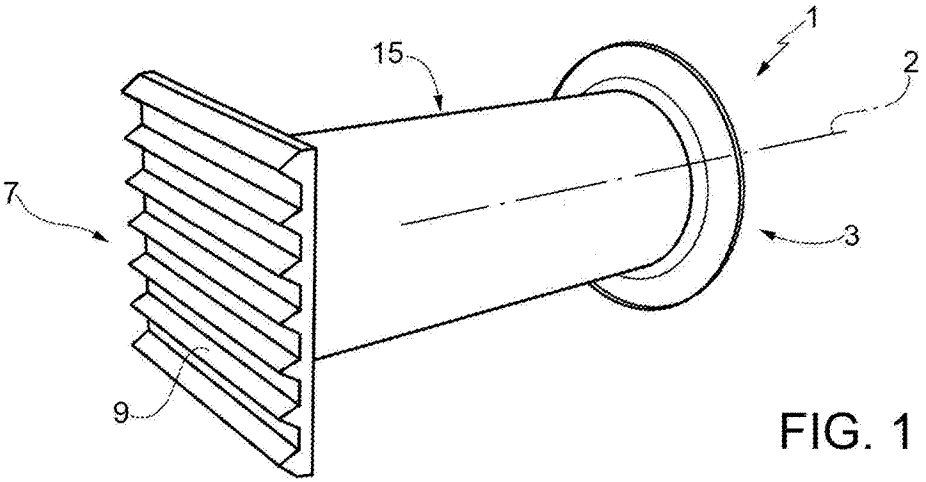
FIG. 1 is a perspective view of a preferred embodiment of the energy-absorbing device, in particular for a rail-car, according to the present invention.

In FIG. 1, the reference number 1 designates an energy-absorbing device, which extends along an axis 2 and comprises, at an axial end thereof, an attachment member 3, which is designed to be fixed in a way known and not described in detail to a supporting structure of a vehicle, in particular of a rail-car (not illustrated).

At the opposite axial end, the device 1 comprises an impact member 7 designed to withstand a head-on collision. Preferably, the member 7 terminates axially with an anti-climbing plate 9, which has a plurality of horizontal ribbings, or other equivalent elements, in order to perform an anti-climbing function when it impacts against a similar plate of another rail-car that forms part of the same train or else of another train.

Figure 2:
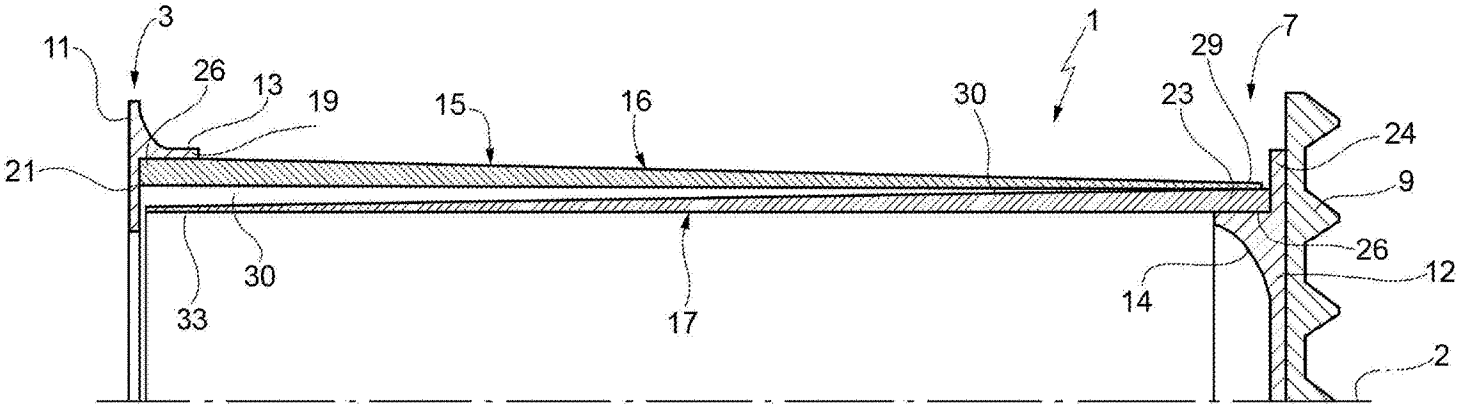
FIG. 2 is a meridian section that shows half of the energy-absorbing device of FIG. 1.

The members 3, 7 are made of metal material, preferably aluminium alloy or steel. As may be seen in FIG. 2, in particular, the members 3, 7 comprise respective plane plates 11, 12 orthogonal to the axis 2, and respective collars 13, 14, which are coaxial along the axis 2 and project from the plates 11, 12 towards one another.

The members 3, 7 are coupled together via an absorber member 15 constituted by a tube 16 and by a tube 17, which are coaxial along the axis 2, are arranged inside one another and are made of composite material.

In particular, each tube 16, 17 is formed by laying on top of one another skins or layers of woven fibre fabric, impregnated with thermosetting resin, and then subjecting the product to polymerization, via appropriate temperature and pressure programs. Other technologies of production could in any case be used.

In particular, each layer of fabric has woven carbon fibres (for example, with a 0°/90° orientation) and is impregnated with epoxy resin. Said resin is selected so as to comply with flammability standards.

As regards the so-called pattern of the weave, what is commonly referred to as "2×2 twill" is preferably used. However, other types of pattern and/or materials (for example, glass or Kevlar) may be used for the fibres constituting the composite material.

The tube 16 has an axial attachment end 19 fixed to the member 3. The end 19 is housed in the collar 13 and axially rests against an inner flange 21 of the plate 11. At the same time, the tube 17 has an axial attachment end 23 fixed to the member 7 so that it is mobile during a head-on collision. In particular, the end 23 is fitted around the collar 14 and axially rests against an outer flange 24 of the plate 12. The ends 19 and 23 are fixed to the collars 13, 14 in such a way as to keep said coupling stable during and after impact, as may be seen in FIGS. 6*a*-6*d*. Preferably, fixing is defined by glue 26 (FIG. 2) so as not to alter the structure of the tubes 16, 17.

According to one aspect of the present invention, the thickness of the tubes 16, 17, measured along the radius, varies along the axis 2. The thickness of the tube 16 decreases starting from the end 19 as far as the opposite free end, which is designated by the reference number 29, is radially more external with respect to the end 23, and axially faces the outer flange 24.

Likewise, the thickness of the tube 17 decreases starting from the end 23 as far as the opposite free end, which is designated by the reference number 33, is radially more internal with respect to the end 19, and axially faces the inner flange 21.

The variation of thickness of the tubes 16, 17 is obtained during forming of the tubes themselves, preferably during the lamination step, i.e., the step in which the various layers of fabric impregnated with resin are wound round one another and are then polymerized.

In other words, wound round the innermost layer are layers of fabric that progressively have a smaller length, measured starting from the ends 19, 23. The degree of variation of the thickness is set down in the design stage, with the aid of appropriate computer simulation programs, so as to guarantee that collapse of the tubes 16, 17 will start from the ends 29, 33 when the latter are axially compressed against the outer flange 24 and against the inner flange 21, respectively, during impact, with a load greater than a threshold, which is also set down in the design stage.

In other words, the tubes 16, 17 start to crumble (or shatter) starting from the ends 29, 33, and this crumbling (or shattering) continues progressively in the direction of the ends 19, 23 so as to absorb the energy of the impact.

During crushing (or shattering), the tube 16 performs a function of guide for the tube 17, either directly or else via elements arranged radially between the tubes 16, 17. In particular, present in a radial direction between the tube 16 and the tube 17 is an extremely small clearance in order to enable axial sliding of the tube 17, as shattering proceeds. At the end 33 of the tube 17 the radial clearance could be slightly greater. This radial clearance may cause a slight misalignment between the tubes 16, 17 during shattering. In any case, this slight misalignment does not jeopardize the guiding function.

Figure 6A:
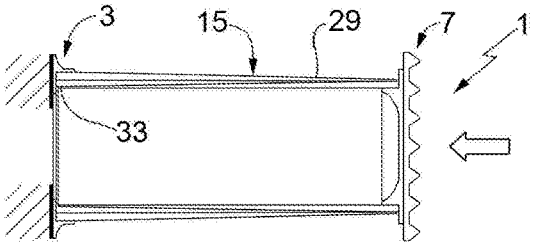
FIGS. 6*a*-6*d* are similar to FIG. 2 and illustrate, in a simplified way, a sequence followed by the energy-absorbing device of the present invention as a result of a head-on collision.
Figure 6B:
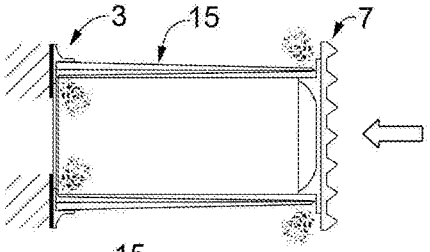
Figure 6C:
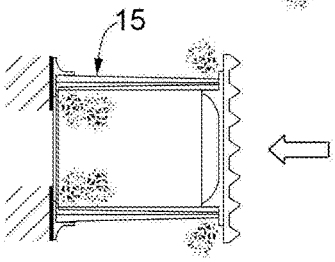

At the same time, in the non-collapsed resting condition (FIGS. 2 and 6*a*) the axial distance or gap between the end 29 and the outer flange 24 is substantially the same as the one between the end 33 and the inner flange 21 so that the tubes 16, 17 start to collapse and hence absorb energy substantially at the same instant and continue to crumble simultaneously (FIGS. 6*b*-6*c*). In this way, the function of guide is performed by the tube 16 throughout the duration of crumbling of the tube 17. For the same reason, the compressive strength of the device 1 during collapse does not present sharp variations or any points of discontinuity, so that the real behaviour of the device 1 basically corresponds to the behaviour expected according to design.

The pieces of the tube 16 that get crushed starting from its end 29 remain outside the device 1 and are scattered in the environment, without occupying any space and/or creating any hindrance to crumbling, in so far as the end 29 is arranged in a radial position further out than the end 23 and the collar 14. At the same time, the pieces of the tube 17 that get crushed starting from its end 33 remain in the axial cavity of the tube 17, given that the end 33 is arranged in a radial position further in than the end 19 and the collar 13.

Figure 6D:
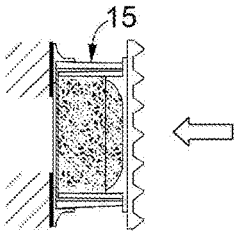

Preferably, the internal axial cavity of the energy-absorbing member 15 is completely empty, and is sized so as to be able to house conveniently the crushed pieces of the tube 17 at the end of collapse (FIG. 6*d*).

In the non-collapsed resting condition, the tubes 16, 17 are held in a fixed relative position, preferably via gluing 30, provided so as to exert a blocking force that, on the one hand, is sufficiently high as to withstand normal conditions of use, in particular vibrations, but on the other hand is sufficiently low as not to affect onset of collapse at the desired load threshold and hence subsequent shattering. In other words, the gluing points 30 define fixing points that are broken or released when the load between the tubes 16, 17 reaches said threshold.

Gluing is a fixing system that does not affect continuity of the fibres of the composite material and, hence, the performance of the energy-absorbing member 15. As a possible alternative (which, however, tends to affect the structure of the composite material), one or more breakable radial pins could be provided.

Figure 4:
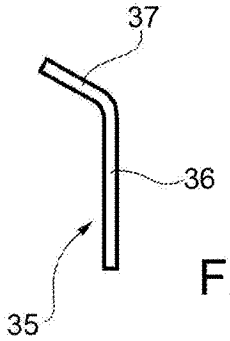
FIGS. 4 and 5 show, at further enlarged scales, the cross section and the development of a component of FIG. 3, respectively.
Figure 5:
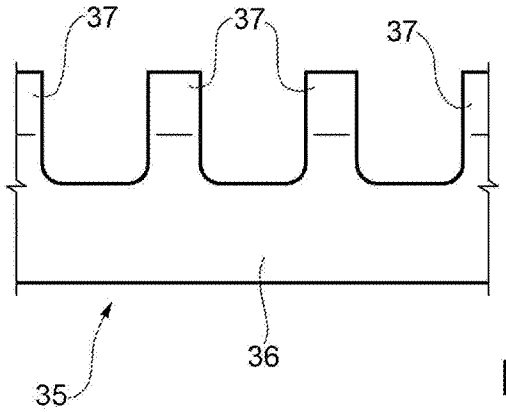
Figure 3:
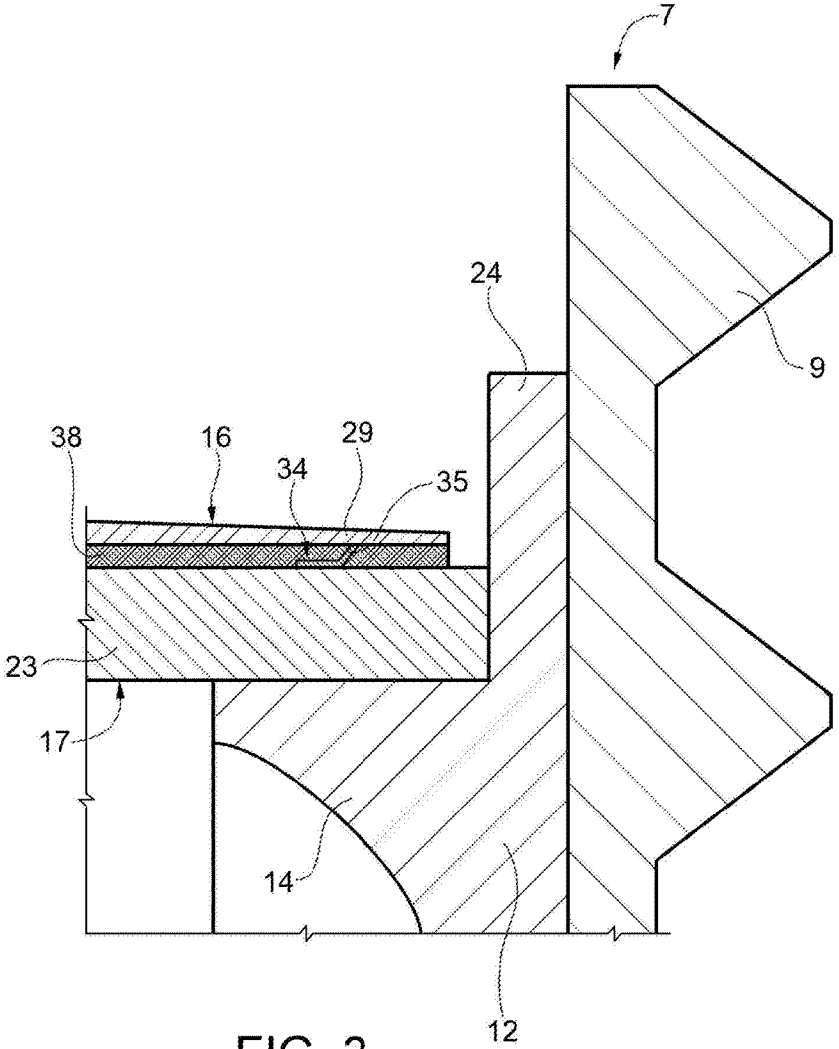
FIG. 3 shows a detail of FIG. 2 at an enlarged scale.

With reference to FIGS. 3 to 5, advantageously the device 1 further comprises a retaining member 34, which is configured so as to prevent the tube 17 from sliding axially out of the tube 16 at the end of impact, without hindering translation of the tube 17 in an opposite axial direction during impact. Preferably, the retaining member 34 is arranged radially between the tubes 16, 17 at the end 23, i.e., in an area that is close to the member 7 and hence remains substantially intact also at the end of impact.

The retaining member 35 comprises a lamina 35, which is fixed by means of gluing to the lateral surface of the tube 17 and is preferably made of metal material. The lamina 35 comprises a portion 36 that extends along the circumference and a plurality of teeth 37 that project axially from the portion 36 and are inclined with respect to the lateral surface of the tube 17 so as to have an edge of their own that is in contact with the tube 16. The teeth 37 project towards the member 7 in such a way as to enable the tube 17 to translate towards the member 3 during impact with a negligible friction with respect to the teeth 37, and to jam against the tube 16 if the tube 17 tends instead to translate in the opposite axial direction.

In order to increase the effect of retention, possibly the roughness, and hence the friction, of the surface of the tube 16 may be increased during the production process. In particular, the lamination mentioned above may be performed by winding the first layers of impregnated fabric round a core (not illustrated) having a mesh, which leaves an impression 38 on the surface of the tube 16 and is then removed when the lamination process is completed.

According to a variant (not illustrated), instead of the lamina 35 the retaining member 34 comprises an element made of elastomeric material, for example of an annular shape, coupled to the inner lateral surface of the tube 16 at the end 19, i.e., in an area that is close to the member 3 and hence remains substantially intact at the end of impact. The element made of elastomeric material has a radial thickness such as to be set at a distance from the tube 17 in a non-collapsed resting condition in order not to affect the threshold of load at which collapse of the device 1 is to start, but during said collapse then comes into contact with the outer lateral surface of the tube 17 so as to prevent it from axially sliding out.

Figure 7:
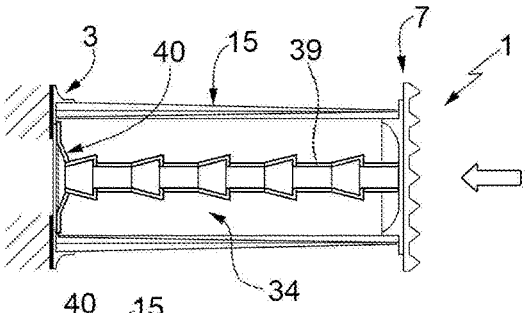
FIGS. 7 and 8 show a first variant of the energy-absorbing device of the present invention, prior to and at the end of a head-on collision.
Figure 8:
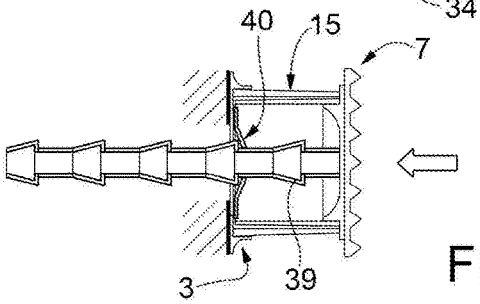

FIGS. 7 and 8 show another possible alternative to the lamina 35. In this case, the retaining member 34 comprises a stem 39, which is parallel to the axis 2, is serrated on the outside, is fixed to the member 7, projects from the member 7 towards the member 3, and is aligned with a retention seat 40. The seat 40 is fixed with respect to the member 3 and is defined by an edge that undergoes deformation upon passage of the teeth of the stem 39 and jams against said teeth to prevent recession of the stem 39 itself at the end of impact. For example, said edge is defined by a plurality of elastically deformable plates. Consequently, during collapse of the device 1, the stem 39 enters the seat 40 and remains withheld in the latter. This solution is less advantageous as compared to the lamina 35, in so far as it requires a space for the stem 39 behind the seat 40 at the end of impact, as may be seen in FIG. 8. In the non-collapsed resting condition, the length of the stem 39 preferably covers the entire space available from the member 7 to the seat 40 so as to make sure that the stem 39 will penetrate into the seat 40.

However, the length of the stem 39 may possibly be smaller.

Figure 9:
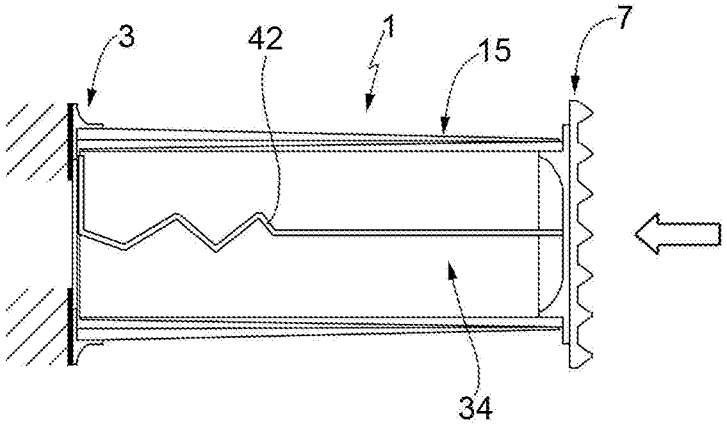
FIGS. 9 and 10 show a second variant of the energy-absorbing device of the present invention, prior to and at the end of a head-on collision.
Figure 10:
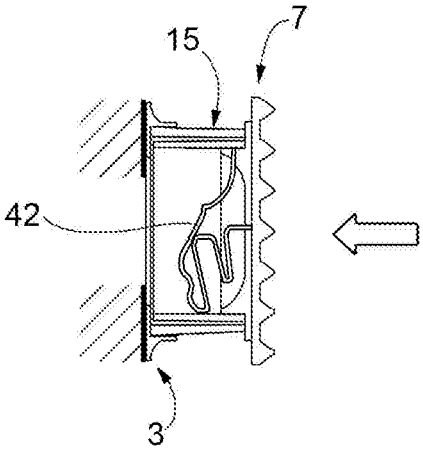

FIGS. 9 and 10 show another alternative. In this case, the retaining member 34 comprises a strap 42, which is preferably made of aluminium alloy and is arranged in the internal cavity of the tube 17. The strap 42 is fixed at its ends to the members 7 and 3. The material, shape, and size of the strap 42 are set down in the design stage so that the strap 42 will undergo plastic deformation without breaking during collapse of the device 1, will not hinder shattering of the tube 17, and will require a relatively small amount of energy of deformation. In the non-collapsed resting condition, for example, the strap 42 may have a rectilinear profile, or an undulated profile, or else a mixed, rectilinear and undulated, profile such as the one shown, for example, in FIG. 9.

Retention of the member 7 at the end of impact is guaranteed by the final plastic deformation of the strap 42, as may be seen in FIG. 10.

From what is set forth above it emerges clearly that the tube 16 performs simultaneously the function of guide and the function of energy absorption so that the structure of the device 1 is much simpler as compared to the prior art, where an additional guide stem must be provided in the internal axial cavity. In other words, the energy-absorbing member 15 is guided autonomously.

The tubes 16, 17 have the same axial length so that the energy-absorbing member 15 manages withstand in an optimal way vertical and lateral loads (so as to comply with the ASME RT1 and ASME RT2 standards). Once again thanks to the length of the tubes 16, 17, the function of guide and the simultaneous collapse of the tubes 16, 17 take place right from onset of collapse, and the energy-absorbing member 15 does not present any sharp variation in compressive strength during impact and in the guiding function.

The aforesaid guiding function makes it possible to withstand in an optimal way any impact that occurs with a load not perfectly aligned along the axis 2. In particular, proper operation is guaranteed also in the event of impact with devices 1 arranged with respect to one another with a vertical offset of 40 mm (as envisaged by the EN15227 standard).

Furthermore, it is not necessary to provide dedicated space for housing an additional guide stem at the end of impact, in the area of or behind the member 3.

Thanks to the fact that the radial thickness of the tubes 16, 17 decreases towards the ends 29 and 33, collapse starts precisely from said ends 29, 33 and proceeds in an axial direction, without any need to envisage additional crushing elements in a position corresponding to the members 3 and 7.

By using two collapsible tubes made of composite material set inside one another, instead of a single tube, it is possible to obtain an energy-absorbing member 15 that undergoes deformation during high-speed impact and that, at the same time, withstands, without undergoing damage, axial stresses of a small degree, defined, for example, by a static load of approximately 50% of the load at which collapse occurs.

In fact, in the case of a single tube, in order to withstand said static load it would be necessary to adopt a relatively large thickness, which, however, would not make it possible to obtain the desired behaviour of collapse during impact.

It is then evident that, thanks to the small overall dimensions of the device 1, the latter can be installed easily on powered railway carriages and coaches already in operation, instead of absorber devices that are less effective.

Finally, from the above description, it emerges clearly that modifications and variations may be made to the device 1 described herein, without thereby departing from the sphere of protection of the present invention.

In particular, the tubes 16, 17 could have a cross section different from the circular one (square, rectangular, star-shaped, lobed, etc.), and/or the lamina 35 could have a shape and/or dimensions different from the ones shown by way of example.

Moreover, the outer tube of the energy-absorbing member 15 could be fixed to the member 7, and hence be mobile during the impact, while the inner tube of the energy-absorbing member 15 is fixed to the member 3.

The invention claimed is:

1. An energy-absorbing device (1), in particular for a rail-car; the device extending along an axis (2) and comprising:

an attachment member (3), which can be connected to a supporting structure;

an impact member (7), designed to withstand an impact; and an energy-absorbing member (15), constituted by a first tube (16) and by a second tube (17), which are coaxial along said axis (2) and are made of composite material so as to collapse and absorb energy in the event of impact; said first tube (16) comprising a first attachment end (19) fixed to said attachment member (3) and a first free end (29) axially facing said impact member (7); said second tube (17) comprising a second attachment end (23) fixed to said impact member (7) and a second free end (33) axially facing said attachment member (3), and being axially slidable, during impact, guided by said first tube (16); the cross sections of said first and second tubes (16, 17) being variable along said axis (2);

characterized in that:

the thickness in the radial direction of said first and second tubes (16, 17) decreases along said axis (2) from said first and said second attachment ends (19, 23) towards said first and second free ends (29, 33), respectively; and in a non-collapsed resting condition, the axial gap between said second free end (33) and said attachment member (3) is substantially equal to the gap between said first free end (29) and said impact member (7) so that said first and second tubes (16, 17) start to collapse simultaneously in the event of impact.

2. The device according to claim 1, characterized by comprising first retaining means (30) that keep said second tube (17) in a fixed position with respect to said first tube (16) in the non-collapsed resting condition and can break or be released when a given threshold of axial load is exceeded.

3. The device according to claim 2, characterized in that said first retaining means are defined by glue (30).

4. The device according to claim 1, characterized by comprising second retaining means (34) that prevent said second tube (17) from moving axially away from said attachment member (3) in a collapsed condition during and/or at the end of impact.

5. The device according to claim 4, characterized in that said second retaining means (34) are arranged radially between said first and second tubes (16, 17).

6. The device according to claim 5, characterized in that said second retaining means (34) are arranged at one of said first and second attachment ends (19, 23).

7. The device according to claim 6, characterized in that said second retaining means (34) comprise a lamina (35) having a first portion (36) fixed to said second attachment end (23), and a second portion (37) that rests against a lateral surface of said first tube (16) and is oriented in such a way as to:

let said second tube (17) slide freely in the case of axial translation towards said attachment member (3); and jam against said lateral surface (16) if said second tube (17) tends to translate axially in the opposite direction.

8. The device according to claim 7, characterized in that said lateral surface has at least one impression (38) so as to increase friction between said lateral surface and said second portion (37).

9. The device according to claim 4, characterized in that at least one part (39; 42) of said second retaining means are arranged in an axial cavity defined by said first and second tubes (16, 17).

10. The device according to claim 9, characterized in that said second retaining means (34) comprise a deformable metal element (40; 42).

* * * * *